United States Patent [19]

Yeamans

[11] Patent Number: 4,912,900

[45] Date of Patent: Apr. 3, 1990

[54] PERIMETER SECUREMENT ASSEMBLY FOR ROOF DECK COVERING

[76] Inventor: Robert C. Yeamans, 2777 Northwest Boulevard, Columbus, Ohio 43221

[21] Appl. No.: 294,038

[22] Filed: Jan. 6, 1989

[51] Int. Cl.[4] ..... E04D 13/15

[52] U.S. Cl. ..... 52/273; 52/60; 52/94; 52/288; 52/713; 160/395

[58] Field of Search ..... 52/58, 60, 273, 748, 52/94, 96, 222, 61, 62, 713, 288; 160/392, 394, 395

[56] References Cited

U.S. PATENT DOCUMENTS

| | | | |
|---|---|---|---|
| 2,041,929 | 5/1936 | Hitzman . | |
| 3,012,376 | 12/1961 | Reddy et al. . | |
| 3,166,177 | 1/1965 | Abadjieff | 160/395 |
| 3,405,485 | 10/1568 | Edwards | 52/60 |
| 3,410,038 | 11/1968 | Gobel | 52/273 X |
| 3,421,276 | 1/1969 | La Barge | 52/94 X |
| 3,783,931 | 1/1974 | Assael | 52/273 X |
| 3,834,104 | 9/1974 | Dunn et al. | 52/96 |
| 3,958,374 | 5/1976 | Gobel | 52/60 |
| 4,018,260 | 4/1977 | Baslow | 52/273 X |
| 4,037,372 | 7/1977 | Patry | 52/96 |
| 4,067,152 | 1/1978 | Wolma | 52/60 |
| 4,241,549 | 12/1980 | Hall, III et al. | 52/60 |
| 4,335,546 | 6/1982 | Kelly | 52/58 |
| 4,403,458 | 9/1983 | Lolley | 52/60 |
| 4,404,777 | 9/1983 | Lolley et al. | 52/94 |
| 4,409,761 | 10/1983 | Bechtel | 52/1 |
| 4,419,850 | 12/1983 | Butzen | 52/60 |
| 4,534,145 | 8/1985 | Yang | 52/273 X |
| 4,549,376 | 10/1985 | Hickman | 52/94 |
| 4,592,176 | 6/1986 | van Herpen | 52/58 |
| 4,598,507 | 7/1986 | Hickman | 52/94 |
| 4,665,670 | 5/1987 | Van Den Burg | 52/222 |
| 4,694,543 | 9/1987 | Conley | 52/222 X |
| 4,759,157 | 7/1988 | Webb et al. | 52/60 |
| 4,817,655 | 4/1989 | Brooks | 52/222 |

FOREIGN PATENT DOCUMENTS

| | | | |
|---|---|---|---|
| 2510424 | 9/1976 | Fed. Rep. of Germany | 52/94 |
| 3039612 | 5/1982 | Fed. Rep. of Germany | 52/94 |

*Primary Examiner*—John E. Murtagh
*Attorney, Agent, or Firm*—John L. Gray

[57] ABSTRACT

A perimeter securement assembly for a roof deck covering involving a one-piece fabricated coved securement base with resilient compression retainers for positively securing said waterproofing membrane roof deck covering therein.

7 Claims, 1 Drawing Sheet

PERIMETER SECUREMENT ASSEMBLY FOR ROOF DECK COVERING

BACKGROUND OF THE INVENTION

At the present time, roof waterproofing membranes used in flat commercial and industrial roofing applications are secured around the periphery of the roof deck by means of mechanical fasteners through the waterproofing membrane, in combination with adhesives and flashing materials. Such applications result in disengagement, puncturing, tearing or otherwise damaging the waterproofing membrane and flashing when the waterproofing membrane billows as a result of wind-uplift forces, a condition associated with changes in atmospheric pressure. Expansion and contraction of the waterproofing membrane and flashing, due to temperature changes, can result in loosening of the waterproofing membrane and flashing from the periphery of the roof deck. The net result is that the roofing application ultimately fails.

SUMMARY OF THE INVENTION

The present invention involves the combination of a one-piece fabricated coved securement base with resilient compression retainers for positively securing the waterproofing membrane, either alone or in combination with the apertured overlay described in applicant's copending patent application Ser. No. 294,023.

A coved securement base may be metallic or nonmetallic, cast, molded, rolled, drawn, extruded, stamped, or formed. The resilient compression retainers may be metallic or nonmetallic. Preferably two resilient compression retailers are used; one retains the waterproofing membrane in the coved portion of the base member and the other retains the apertured overlay on top of the waterproofing membrane in the coved portion of the base. However, in some applications a single resilient retainer may be used, either to secure the waterproofing membrane or to secure both the waterproofing membrane and the apertured overlay.

It is therefore an object of this invention to provide a perimeter securement assembly for a roof deck covering for securing roof waterproofing membrane without puncturing or damaging the membrane by means of mechanical fasteners or disengagement of adhesives.

It is also an object of this invention to provide roof perimeter securement assembly which may be used to hold a roof waterproofing membrane, or a roof membrane and an apertured overlay, securely on a roof deck.

These, together with other objects and advantages of the invention will become more readily apparent to those skilled in the art when the following general statements and descriptions are read in the light of the appended drawings.

DETAILED DESCRIPTION OF THE INVENTION

Figure 1:
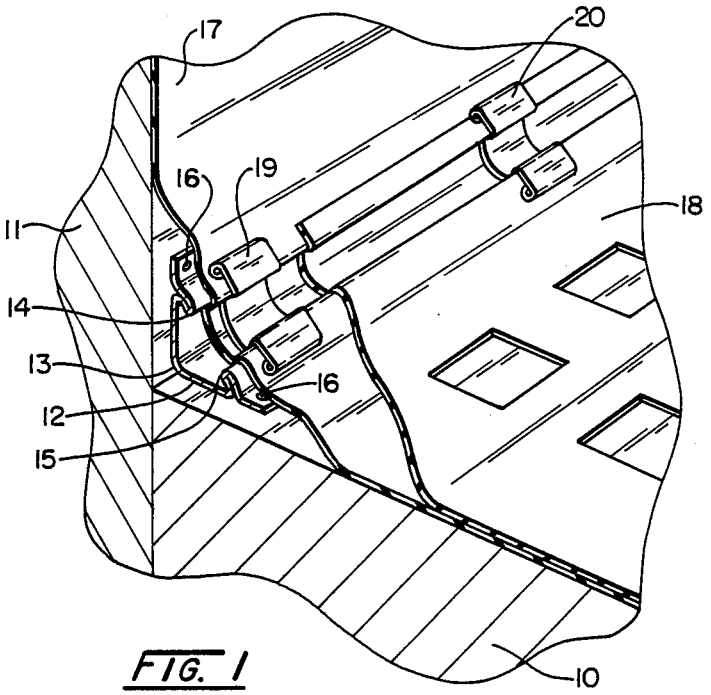
FIG. 1 is a perspective view of the applicant's invention with portions of the apertured overlay broken away.

Referring now more particularly to FIG. 1, the roof deck is shown at 10 adjacent to a parapet or wall 11. The base member 12 of the applicant's invention comprises a coved section 13 and two complementary elements 14 and 15 extending inwardly. The base member 12 may be cast, molded, rolled, drawn, extruded, stamped, or formed and may be made from a metallic or a nonmetallic material. The base member 12 may be attached to the parapet or wall 11 and the roof deck 10, or a nailing strip on the roof deck, by fasteners 16—16. As shown, the waterproofing membrane 17 lies on the roof deck 10, and is covered with an apertured overlay 18. Resilient compression retainers 19 and 20 are shown with resilient compression retainer 19 holding waterproofing membrane 17 in place in the base member 12 adjacent the elements 14 and 15. Preferably the resilient retainers 19 and 20 are designed so that they engage a substantial portion of the interior surfaces and edges of elements 14 and 15. The waterproofing membrane 17 also extends over and adjacent the elements 14 and 15 and preferably is pdressed against the interior surfaces and the edges of elements 14 and 15. The apertured overlay 18 has been cut away to show the position of the resilient compression retainer 19. An identical resilient compression retainer 20 is shown holding the apertured overlay in place atop waterproofing membrane 17. The resilient compression retainers 19 and 20 preferably are about two inches wide, are placed alternately on approximate one-foot centers, and preferably are constructed of stainless steel. The base member 12 may be any suitable length. The length is only restricted by the means for its transportation. The waterproofing membrane 17 may be fastened to the parapet or wall 11 by any suitable means well-known in the art. If there is no parapet or wall 11, a fascia may be used which will extend over the upper portion of the base member 12 with the waterproofing membrane 17 being enclosed between fascia and base member 12 thereby in a conventional method of terminating the waterproofing membrane. The apertured overlay 18 which covers the waterproofing membrane 17 to prevent billowing is described in detail in applicants copending patent application Ser. No. 294,023.

Figure 2:
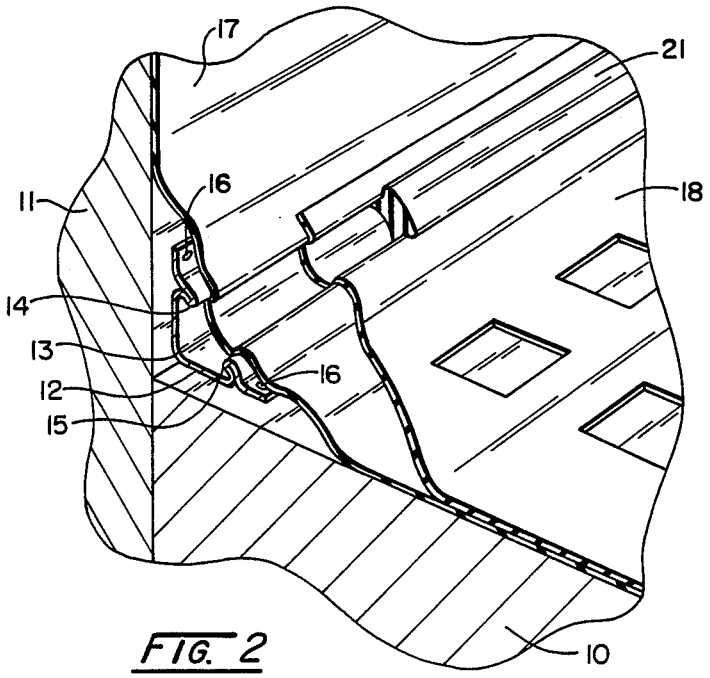
FIG. 2 is a modification of applicant's invention showing a different type of resilient compression retainer.

Referring now more particularly to FIG. 2, there is shown a different type of resilient compression retainer 21. This is a resilient solid or tubular member. In this instance, both the waterproofing membrane 17 and the apertured overlay 18 have been forced into the coved section 13 of the base member 12 behind and adjacent the elements 14 and 15 and the resilient member 21 is pressed into the resulting space which it is designed to fit. Of course, the resilient member 21 may be used with the waterproofing membrane 17 alone, if the apertured overlay 18 is not used. The resilient solid or tubular member 21 may be an extrusion made of any suitable material which is flexible enough so that it may be forced in between and behind the complimentary elements 14 and 15 so as to hold the apertured overlay 18 and the waterproofing membrane 17 in place. Certain forms of rubber and plastic are satisfactory.

The use of this perimeter securement assembly for a roof covering assures a permanent securement of the waterproofing membrane and an apertured overlay, if used, without mechanically puncturing or adhesively securing the waterproofing membrane. This system may be used with conventional ballast or any other existing methods of installing a waterproofing membrane although, of course, the preferred use is with the apertured overlay 20.

While this invention has been described in its preferred embodiment, it is to be appreciated that variations therefrom may be made without departing from the true scope and spirit of the invention.

What is claimed:

1. In a roof deck covering comprising a waterproofing membrane positioned on the surface of said roof deck, a perimeter securement assembly for a roof deck covering for securely fastening said waterproofing membrane to the periphery of said roof deck comprising, a base member capable of being firmly attached to said roof deck and designed to extend along and adjacent to the edge of said roof deck and including an essentially flat first portion designed to be substantially parallel to the surface of said roof deck, a first means on said first portion for enabling said first portion to be attached to said roof deck, and an essentially flat second portion connected to said first portion and extending essentially at right angles to said first portion and adjacent the edge thereof, a second means on said second portion for enabling said second portion to be attached to a vertical wall adjacent to said roof deck, said first portion of said base member being provided with a first element extending in a direction toward said second portion of said base member, and said second portion of said base member being provided with a second element extending in a direction towards said first portion of said base member, a resilient means of a shape conforming to that portion of said base member between said first and second elements and adapted to press said waterproofing membrane securely against said base member between said first and second elements.

2. In a roof deck covering comprising a waterproofing membrane positioned on the surface of said roof deck and an apertured overlay positioned atop said waterproofing membrane and essentially coextensive therewith, a perimeter securement assembly for a roof deck covering for securely fastening said waterproofing membrane and said apertured overlay to the periphery of said roof deck comprising, a base member capable of being firmly attached to said roof deck and designed to extend along and adjacent to the edge of said roof deck and including a first portion designed to be substantially parallel to the surface of said roof deck and a second portion connected to said first portion and extending essentially at right angles to said first portion and adjacent the edge thereof, said first portion of said base member being provided with a first element extending in a direction toward said second portion of said base member, and said second portion of said base member being provided with a second element extending in a direction toward said first portion of said base member, a first resilient means of a shape conforming to that portion of said base member between said first and second elements and adapfted to press said waterproofing membrane and said apertured overlay securely against said base member between said firsgt and second elements.

3. The perimeter securement assembly of claim 2 including a second resilient means of a shape conforming to the shape of said first resilient means and wherein said first resilient means is adapted to hold said waterproofing membrane against said base member between said first and second elements and said second resilient means is adapted to hold said apertured overlay against said waterproofing membrane while said waterproofing membrane is held against said base member between said first and second elements.

4. The perimeter securement assembly of claim 1 wherein said resilient means also extends over said two elements.

5. The perimeter securement assembly of claim 1 wherein said resilient means is adapted to hold said waterproofing membrane securely against said base member adjacent said first and second elements.

6. The perimeter securement assembly of claim 2 wherein said first resilient means is adapted to hold said waterproofing membrane securely against said base member adjacent said first and second elements.

7. The perimeter securement assembly of claim 3 wherein said first resilient means is adapted to hold said waterproofing membrane securely against said base member adjacent said first and second elements and wherein said second resilient means is adapted to hold said apertured overlay securely against said waterproofing membrane while said waterproofing membrane is held securely against said base member adjacent said first and second elements.

* * * * *